US006158740A

United States Patent [19]

Hall

[11] Patent Number: 6,158,740

[45] **Date of Patent: *Dec. 12, 2000**

[54] CUBICLE PUZZLE GAME

[76] Inventor: Albert J. Hall, 2985 SW. 136th Ave., Davie, Fla. 33330

[ * ] Notice: This patent is subject to a terminal disclaimer.

[21] Appl. No.: 09/178,698

[22] Filed: Oct. 26, 1998

Related U.S. Application Data

[63] Continuation-in-part of application No. 08/942,911, Oct. 2, 1997, Pat. No. 5,826,872.

[51] Int. Cl.[7] ..... A63F 9/08

[52] U.S. Cl. ..... 273/156

[58] Field of Search ..... 273/153 R, 156, 273/153 S, 157 R; 473/594, 577, 614; 446/901, 124, 125, 126

[56] References Cited

U.S. PATENT DOCUMENTS

| | | | |
|---|---|---|---|
| 3,008,719 | 11/1961 | Misko | 473/594 |
| 3,655,201 | 4/1972 | Nichols | 273/153 R |
| 3,659,360 | 5/1972 | Zeischegg | 273/157 R |
| 4,205,850 | 6/1980 | Craig | 273/157 R |
| 4,513,970 | 4/1985 | Opresco et al. | 273/153 S |
| 5,199,716 | 4/1993 | DeFluiter et al. | 473/572 |
| 5,340,349 | 8/1994 | Berg-Fernstrum | 446/901 |
| 5,411,262 | 5/1995 | Smith | 273/157 R |
| 5,826,872 | 10/1998 | Hall | 273/156 |

FOREIGN PATENT DOCUMENTS

| | | | |
|---|---|---|---|
| 0295787 | 12/1988 | European Pat. Off. | 446/125 |

*Primary Examiner*—Steven Wong
*Attorney, Agent, or Firm*—Law Offices of Brian S. Steinberger; Brian S. Steinberger

[57] ABSTRACT

A toy puzzle including a plurality of individual pieces that can be assembled into a geometrically solid shape, such as spherical, is provided. In one embodiment, the individual pieces can include a truncated conical base member with a central spindle protruding perpendicularly from the center of the base. The pieces can have truncated conical base members of the same or different sizes. The spindle has metal in at least the end opposite the base that is attracted and held by a magnet. Upon assembly of the plurality of individual pieces, the magnet will be disposed at the center of a resulting object of preselected shape. In an alternate embodiment, a equilateral pyramid may be formed having a triangular base from six identical pieces. In yet another embodiment, a cube can be formed from twelve identical pieces that are also joined to the magnet in the center.

1 Claim, 8 Drawing Sheets

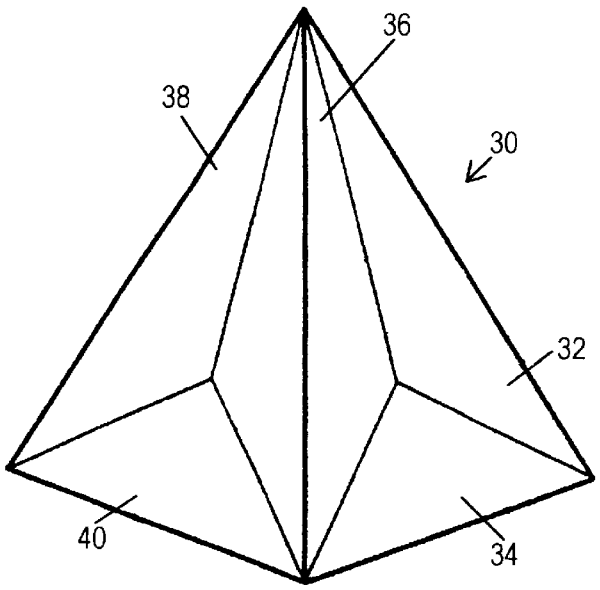
FIG. 9
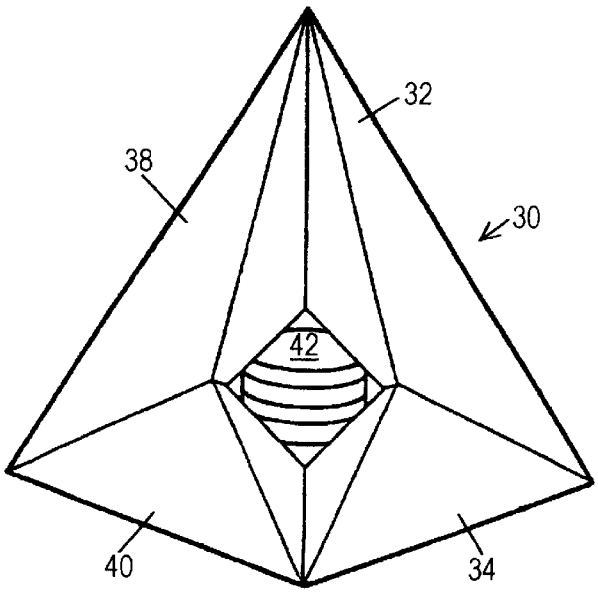
FIG. 10
FIG. 11
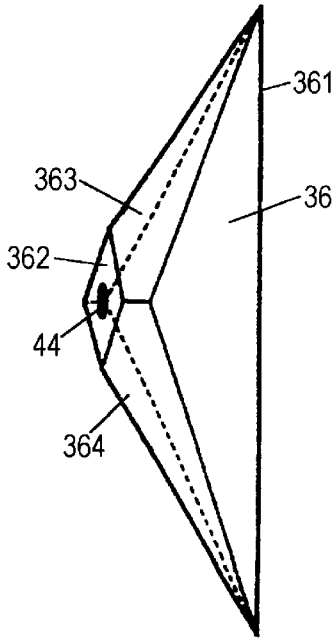

CUBICLE PUZZLE GAME

This application is a continuation-in-part of U.S. patent application Ser. No. 08/942,911, filed Oct. 2, 1997 now issued U.S. Pat. No. 5,826,872 to be issued on Oct. 27, 1998.

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

This invention relates to puzzles and toys, and more particularly to puzzles and toys that include individual pieces that can be joined together to form a three-dimensional object that can include a sphere, or a pyramid or a cube.

2. Description of Related Art

Puzzle solvers enjoy the challenge of puzzles that require some manual dexterity and skill to solve. Puzzles of the type which are comprised of a plurality of individual parts that are held together by magnets to form various shaped objects are known in the art.

U.S. Pat. No. 5,127,652, to Unger, discloses a toy of various geometrically solid shapes that can break into a plurality of individual pieces by prying or throwing against a hard object. The individual pieces of the toy each contain a plurality of magnets placed in preselected locations to enable the user to reassemble the toy into the solid shape. As disclosed in the '652 patent, the positioning and installation of the magnets into each individual piece requires some forethought and testing. The preplanning and testing necessary to position the magnets can add to the complexity and cost of the manufacturing process.

U.S. Pat. No. 5,411,262, to Smith, discloses a plurality of essentially two dimensional pieces that can be assembled to form a hollow three-dimensional object. Each individual piece has at least three edges and includes a magnet attached to each edge for joining together with adjacent pieces. The orientation of the north and south poles of the magnets is important for reassembly of the object, and must be preplanned before manufacturing can begin.

U.S. Pat. No. 3,659,360 issued to Zeischegg, May 2, 1972 shows a construction set using polyhedrons connected constructed from polyhedron components, including a cube and a pyramid that are held together by an adhesive. U.S. Pat. No. 3,655,201 issued to Nichols, Apr. 11, 1972, shows a cube type piece magnetically engaged to form assembly with educational features. U.S. Pat. No. 4,258,479 issued to Roane, Mar. 31, 1981, shows tetrahedron blocks capable of assembly in the cubes and pyramids. U.S. Pat. No. 5,271,688 issued to Chang, Dec. 21, 1993, shows a magic square with a six axis joined together in the center. U.S. Pat. No. 5,660,387 issued to Stokes, Aug. 26, 1997, shows a polyhedron puzzle that has several pieces that can be fitted together. U.S. Pat. No. 4,674,750 issued Jun. 23, 1987 shows a dual dodecahedron class cubic puzzles.

There is always the need for new and challenging puzzle for the puzzle solver. There is a further need for the puzzle to be educational for children by teaching problem solving skills and manual dexterity. In addition, there is always a need for puzzles that are quickly and easily manufactured, and that are sturdy and reasonably priced.

SUMMARY OF THE INVENTION

The present invention provides a toy puzzle including a plurality of individual pieces that can be assembled into a geometrically solid shape, such as spherical. The individual pieces are each identical and can include a truncated conical base member with a central spindle protruding perpendicular from the center of the base. The spindle has metal in at least the end opposite the base that is attracted and held by a single magnet. Upon assembly of the plurality of individual pieces, the magnet will be disposed at the center of the resulting spherical shaped object.

Assembly of a spherical shaped object using a single central magnet and a plurality of individual pieces that radiate outward from the magnet and end in a truncated conical base member requires some patience, skill, and manual dexterity.

Because the plurality of individual pieces can be identical, and only one central magnet is required, the toy is easily and quickly manufactured. In an alternate embodiment, the individual pieces consist of pieces with different sized base members. However, the toy is still easily and quickly manufactured because the pieces are all uniform.

The puzzle can also comprise a geometric figure of a pyramid having an equilateral triangular base that is constructed from six identical polyhedrons. Also, the puzzle can be comprised of individual elements surrounding a magnet that have to be manually positioned with agility and skill to form a cube having 12 identical pieces.

Accordingly, it is an object of the present invention to provide a puzzle that presents an enjoyable challenge for the puzzle solver.

It is a further objective of the present invention to provide a puzzle that includes a plurality of pieces that combine together by a single magnet to form a spherical shaped object, a pyramid shaped object and a cube shaped object.

It is still a further objective of the present invention to provide a puzzle that requires some level of problem solving skill and manual dexterity to assemble, and which is educational for children by teaching these skills.

In accordance with these and other objects which will become apparent hereinafter, the instant invention will now be described with particular reference to the accompanying drawings.

BRIEF DESCRIPTION OF THE DRAWINGS

FIG. 9 shows a perspective view of a pyramid in accordance with the present invention.

FIG. 10 shows a perspective view of a pyramid in accordance with the present invention with one of the pieces or components of the pyramid removed showing the magnet in a central location.

FIG. 11 shows a perspective view of the removed piece from FIG. 10 that includes a metal portion that can be magnetically attracted to the magnet shown in the center of FIG. 10.

DESCRIPTION OF THE PREFERRED EMBODIMENT

Figure 1:
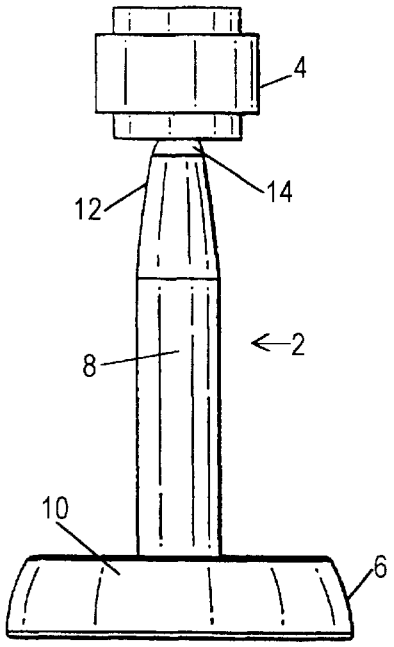
FIG. 1 is front elevational view of one of the plurality of individual pieces and the magnet of a first embodiment of the present invention.
Figure 2:
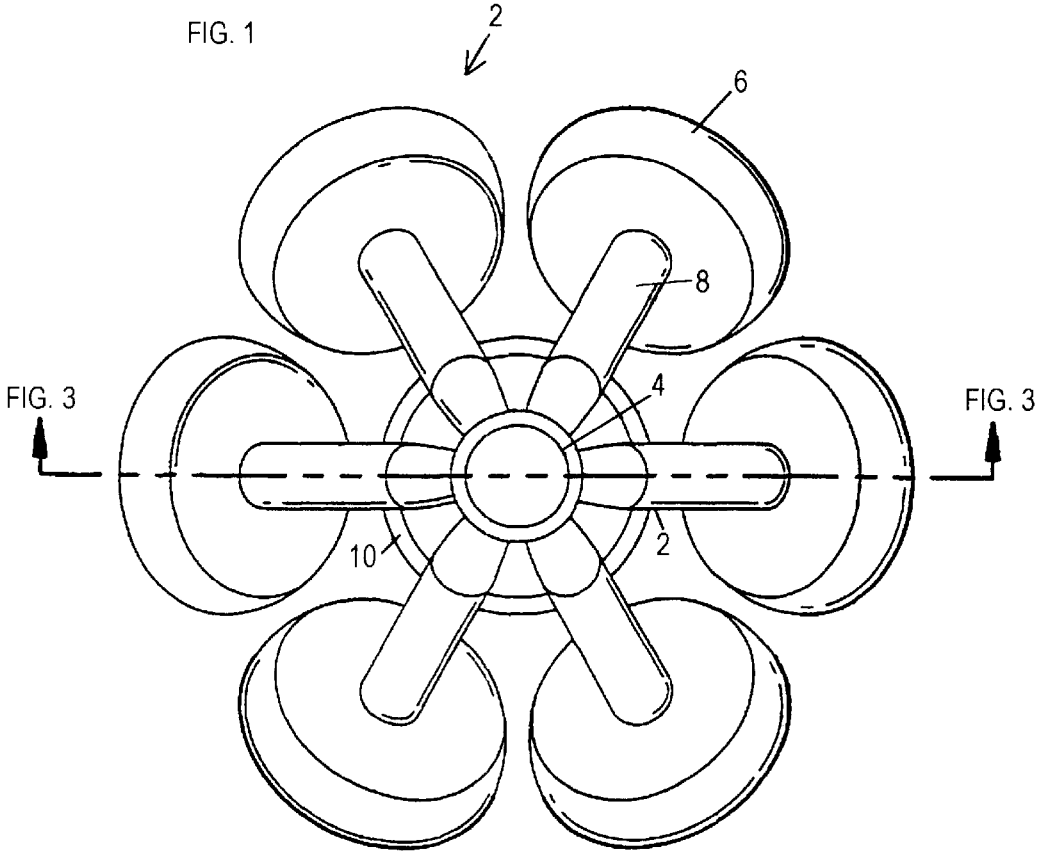
FIG. 2 is a top plan view of the embodiment of FIG. 1, illustrated partially assembled.

Referring to FIG. 1, a first embodiment of the present invention utilizes a plurality of identical puzzle pieces 2, and a single central magnet 4. FIG. 1 illustrates a single puzzle piece 2 magnetically attached to magnet 4. FIG. 2 illustrates a top plan view of the first embodiment partially assembled showing six (6) identical puzzle pieces 2 magnetically attached to magnet 4. Magnet 4 can be a single magnet or a combination of a plurality of individual magnets, which may be disc shaped and magnetically connected together to form a single contiguous magnet.

Each puzzle piece 2 includes a truncated conical base member 6 of a predetermined diameter and thickness. The axis of the truncated cone is aligned coaxially with a shaft or spindle member 8 of predetermined length that forms the radius of the resulting spherical toy. As described herein below, a preselected number of pieces 2 are required, with a preselected radius or spindle member 8 length and base member 6 diameter, to form the resultant sphere.

Spindle member 8 can be a somewhat elongated member, such as a shaft, tube, or bar of circular or non-circular cross-section, that extends substantially perpendicularly from the center of base member 6. Base member 6 includes a beveled surface 10 extending circumferentially around base 6. Spindle member 8 can include beveled end 12, and metal tip 14 for attraction to magnet 4.

Figure 3:
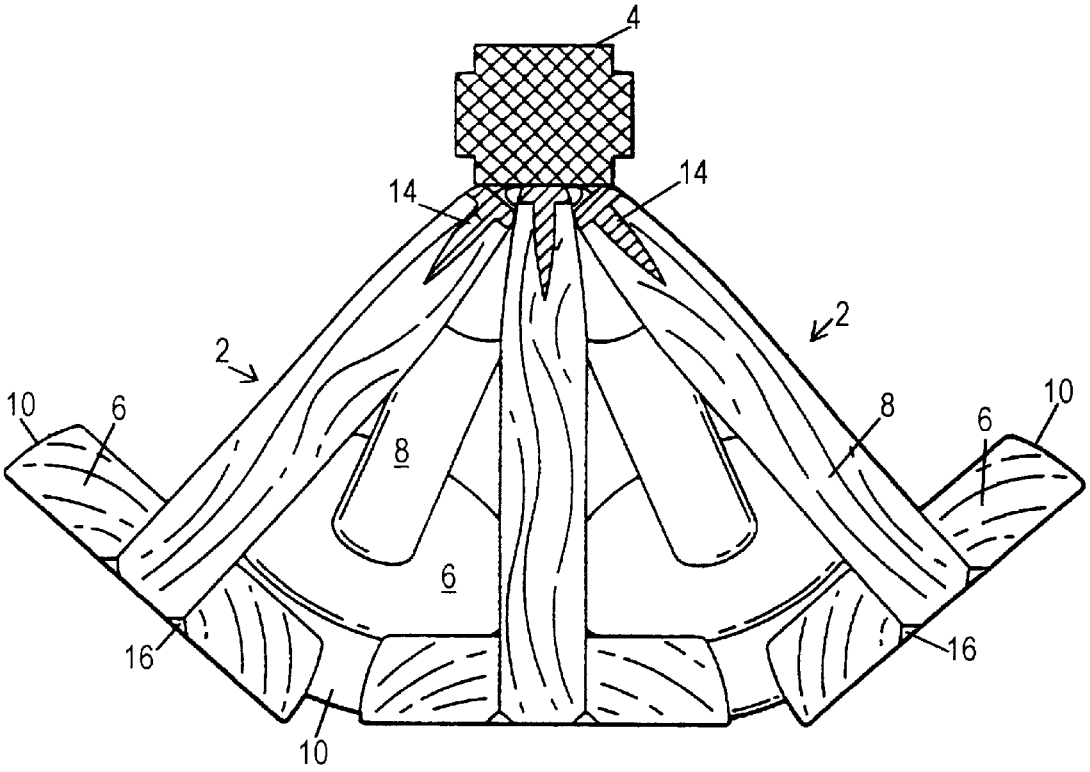
FIG. 3 is a front elevational sectional view, taken along line 3—3 in FIG. 2.

Referring to FIGS. 2 and 3, six (6) puzzle pieces 2 are illustrated magnetically attached to magnet 4 as the puzzle is being assembled. (Five (5) puzzle pieces 2 are illustrated in FIG. 3). Beveled surfaces 10 and 12 are appropriately selected to closely accommodate the plurality of adjacent puzzle pieces 2 as the sphere 20 is assembled.

Puzzle piece 2 can be made of any suitable material such as wood, plastic, metal, and the like. In one embodiment, puzzle piece 2 can be made of wood. Base member 6 can be through-bored resulting in aperture 16, and sized to received spindle member 8 which can be pressed and glued into aperture 16 in base 6. Metal tip 14 can be a metal fastener that can be inserted or screwed into the end of spindle member 8 opposite base member 6, as illustrated in FIG. 3.

As more and more puzzle pieces 2 are added to magnet 4, skill and dexterity is required to hold the growing spherical shaped object while simultaneously adding puzzle pieces 2.

Figure 4:
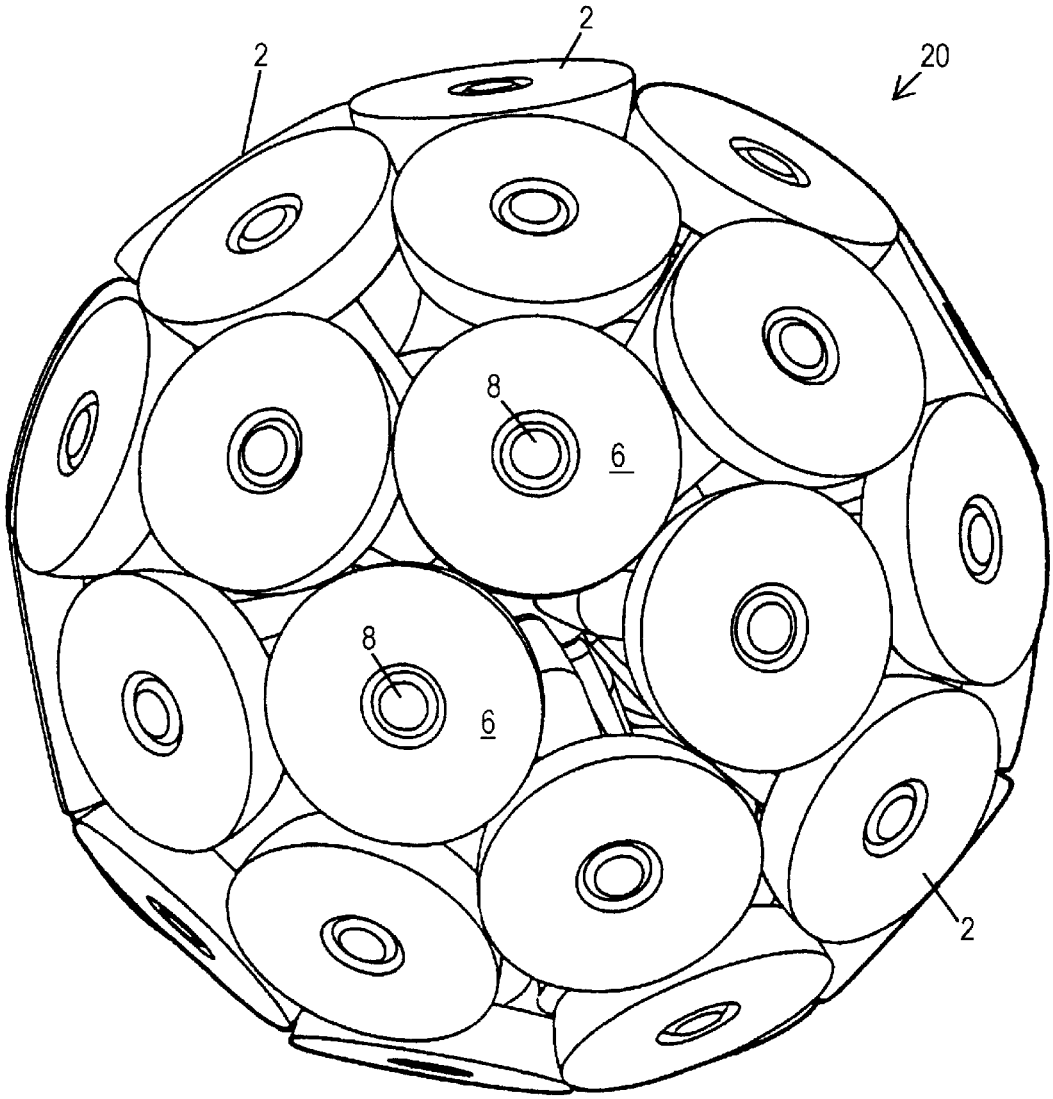
FIG. 4 is a perspective view of a first embodiment of the present invention shown assembled.

Referring to FIG. 4, when all the puzzle pieces 2 have been attached magnetically to magnet 4, spherical toy 20 is formed. As illustrated in FIG. 1, magnet 4 can have a somewhat irregular shape, and does not itself need to be spherical or rounded to assemble the puzzle. Once formed, the puzzle toy 20 can be broken down into individual puzzle pieces 2 for another reassembly.

Because puzzle pieces 2 are all identical in the first embodiment of the invention discussed herein above, and only one magnet is needed, the toy can be easily, quickly, and inexpensively manufactured.

The size of the puzzle pieces 2, and resultant size of puzzle 20 can be preselected to nearly any desired sizes. The ratio of the sizes of base member 6, spindle length 8, and magnet 4 is important so that assembly will result in a spherical shaped object.

In one embodiment, there are 38 individual puzzle pieces 2. Each puzzle piece 2 includes a base member 6 with a maximum diameter of approximately 5.5 cm, and a spindle member 8 total length of approximately 7.6 cm. Magnet 4 is approximately just slightly over 2 cm in diameter. The above dimensions result in a spherical object 20 having a radius of approximately 8.6 cm.

To determine alternate dimensions for the individual puzzle pieces 2 and sphere 20, the equations for the surface area of a sphere ($4\pi R_1^2$) and for the area of a circle ($\pi R_2^2$), where $R_1$ is the radius of the sphere 20 and $R_2$ is the radius of base member 6, can be utilized. Using these equations and the dimensions given herein above for one embodiment of the invention, it is simply a mathematical problem to calculate that 38 individual pieces will be required to complete the sphere.

The calculations can be used to determine the approximate number of circles of a given radius that will be required to fill the surface area of a sphere of given radius. The size of sphere 20 and the size and number of individual puzzle pieces 2 can be varied, according to the desires of the puzzle builder, by varying the parameters of the equations.

The assembled puzzle sphere 20, as illustrated in FIG. 4, includes spaces between adjacent base members 6 on the surface of sphere 20. A second embodiment of the present invention includes puzzle pieces 2 that have two different size base members 6 that results in a reduction of the void areas on the spherical surface between adjacent base members 6. In the following description of the second embodiment of the present invention, elements that are identical to elements of the first embodiment 20 have the same reference numbers.

Figure 5:
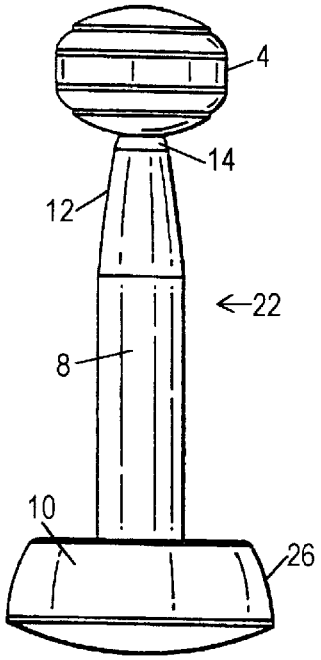
FIG. 5 is front elevational view of one of the plurality of individual pieces and the magnet of a second embodiment of the present invention.

Referring to FIG. 5, puzzle piece 22 is illustrated attached to magnet 4. As discussed herein above, magnet 4 can be a single magnet or a combination of a plurality of individual magnets. Puzzle piece 22 includes spindle member 8 and truncated conical base member 26. Utilizing the example herein above in which puzzle piece 2 includes base member 6 having a maximum diameter of approximately 5.5 cm, base member 26 can have a maximum diameter of approximately 4 cm. Spindle member 8 will retain a total length of approximately 7.6 cm.

Figure 6:
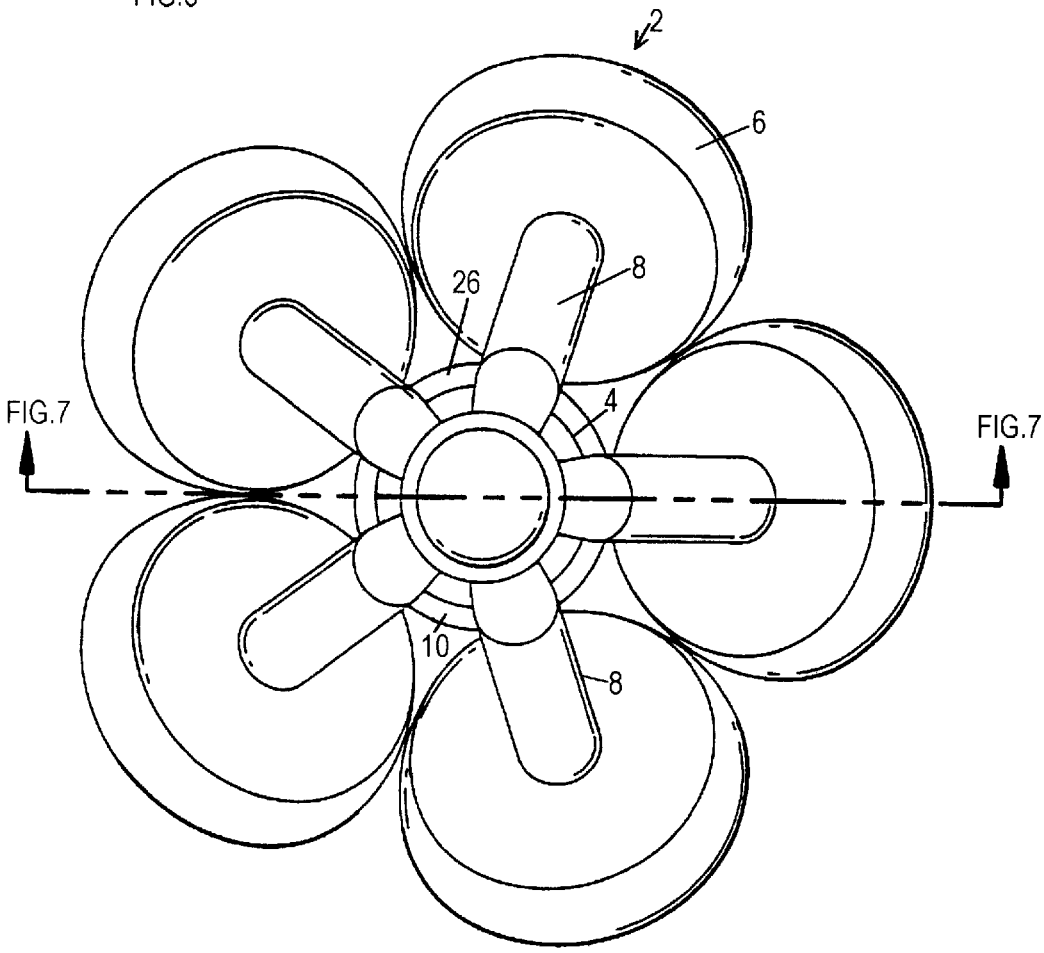
FIG. 6 is a top plan view of the embodiment of FIG. 5, illustrated partially assembled.
Figure 7:
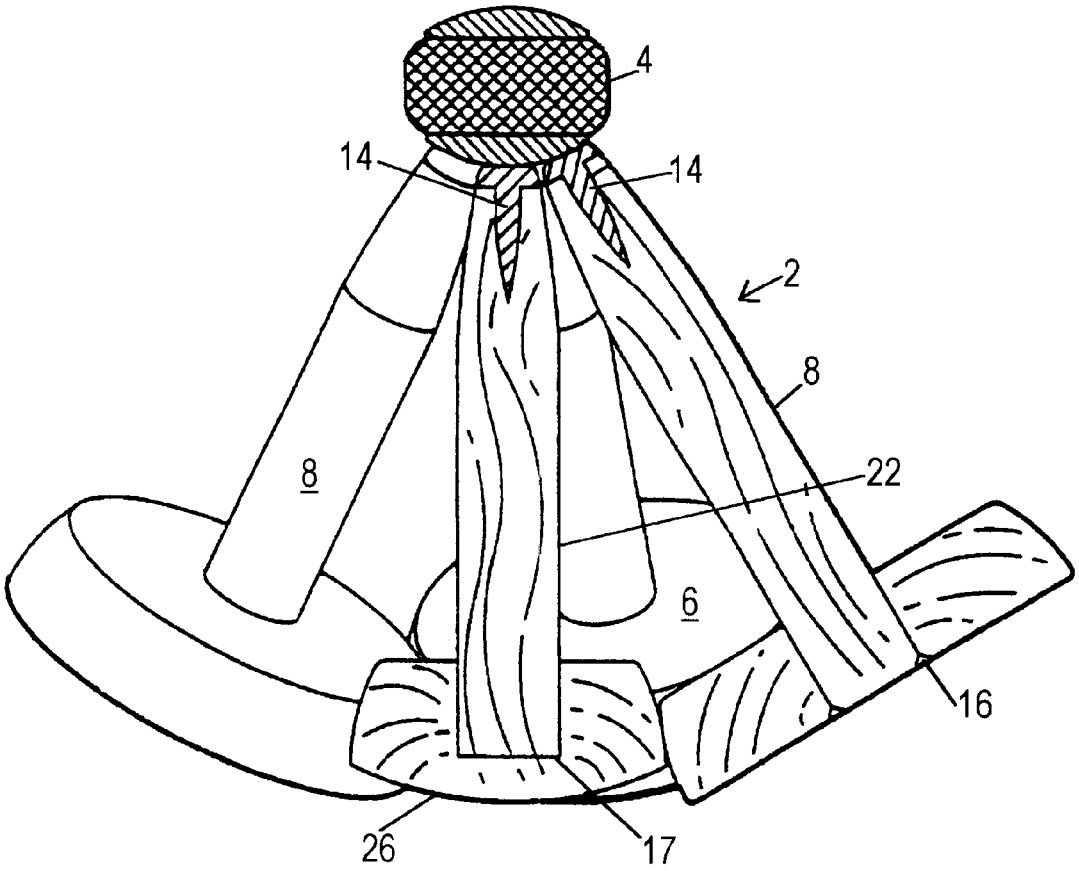
FIG. 7 is a front elevational sectional view, taken along line 7—7 in FIG. 6.

Referring to FIGS. 6 and 7, puzzle piece 22 is illustrated attached by spindle 8 to magnet 4, and surrounded by five (5) puzzle pieces 2 also attached by spindle 8 to magnet 4. As shown in FIGS. 6 and 7, base member 26 is smaller than base member 6, and substantially fills the void defined by five (5) base members 6 that are side-by-side adjacent each other with attached spindles 8 connected to magnet 4.

As illustrated in FIG. 7, base member 26 can be partially through-bored 17 to receive spindle member 8. Base member 26 can alternately be through-bored in similar manner to base member 6, and base member 6 can be partially through-bored to receive spindle member 8. Spindle member 8 thus can be attached to base members 6 and/or base members 26 in any suitable manner, including pressed, glued, screwed, bolted, or being made together with the base member as an integral part thereof.

FIG. 6 illustrates the initial phase of the solution, or method to correctly assemble the second embodiment of the invention. As stated above, the initial phase comprises attachment of one (1) piece 22, and five (5) pieces 2 to magnet 4. The remainder of the method includes sequentially and symmetrically building the sphere by adding the following: a) attachment of five (5) pieces 2 to magnet 4; b) attachment of five (5) pieces 22; c) attachment of ten (10) pieces 2; d) five (5) pieces 22 are then arranged around and positioned onto the ten (10) pieces 2, with each piece 22 adjacent or in-line with one of the five (5) previously attached puzzle pieces 22; e) attachment of five (5) larger pieces 2; f) attachment of five (5) larger pieces 2; and, g) attachment of the final piece 22.

Figure 8:
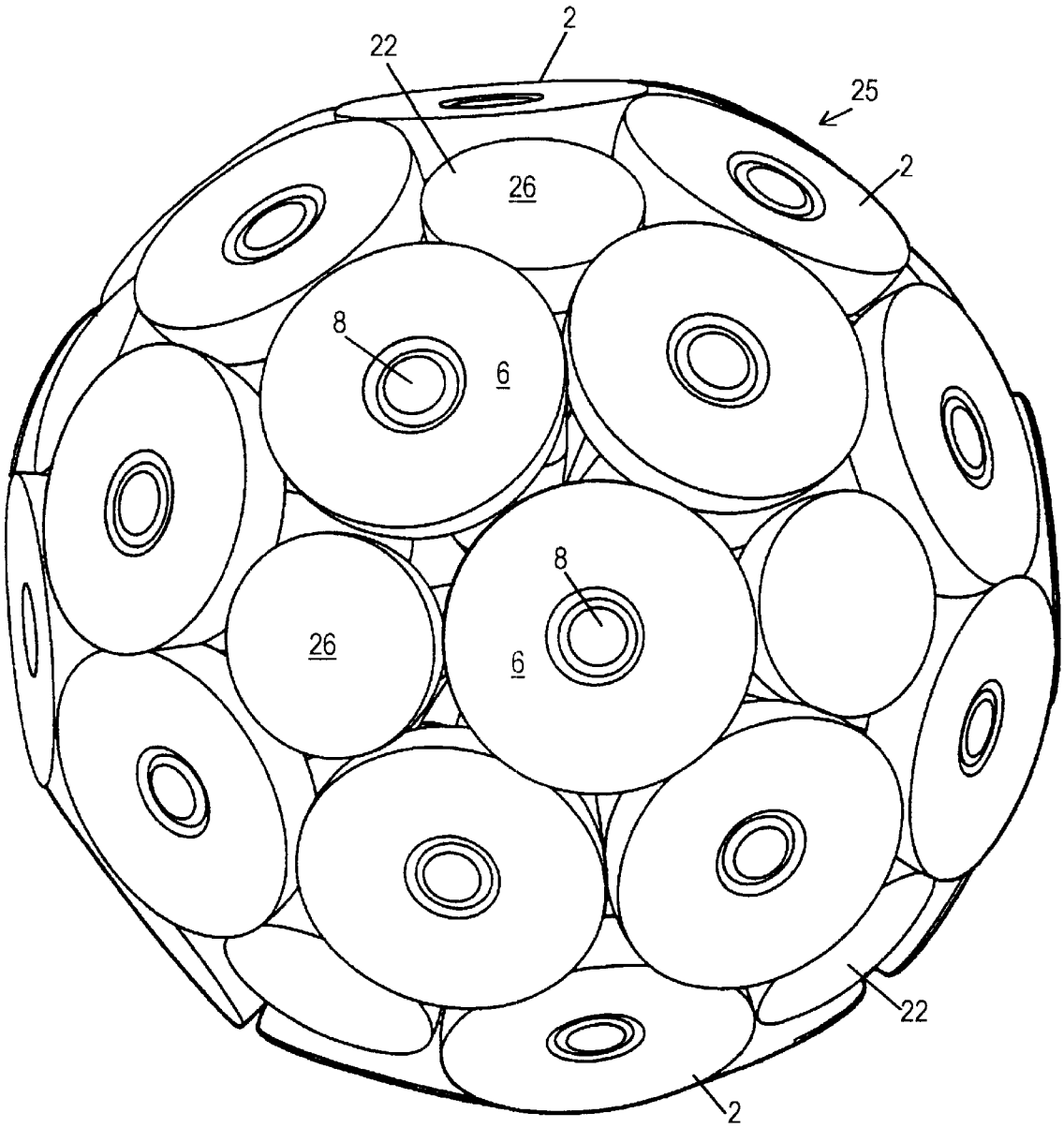
FIG. 8 is a perspective view of a second embodiment of the present invention shown assembled.

Referring to FIG. 8, the second embodiment of the present invention 25 includes 12 pieces 22 with smaller bases 26, and 30 pieces 2 with larger bases 6 for a total of 42 puzzle pieces. Utilizing the two sizes of base members 2 and 22 results in a sphere 25 having minimum space between bases 6 and 26. Because the puzzle pieces 2 and 22 are uniform and include identical spindle members 8, puzzle 25 is easy and inexpensive to manufacture.

In addition, while a spherical shaped puzzle 20 or 25, utilizing puzzle pieces 2 and/or 22 having truncated conical base members 6 or 26, are the preferred embodiments, alternate embodiments are possible and considered to fall within the scope of the present invention. For example, a spherical puzzle 20 utilizing puzzle pieces 2 having base members 6 with other shapes, such as pentagonal, hexagonal, and the like, is contemplated. In addition, the assembled puzzle 20 could result in a geometric solid shape other than spherical.

In an alternate embodiment referring now to the drawings, a pyramid puzzle 30 is shown comprised of six individual identical polyhedrons defining elements 32, 34, 36, 38 and 40 with one more corresponding element on the hidden side of the pyramid 30 as shown. The geometrical shape shown in FIG. 9 is a pyramid having an equilateral triangular base defining three sided pyramid. The puzzle is made up of a plurality of six polyhedrons that are held together by a central magnet 42 shown in FIG. 10. Each of the elements 32, 34, 36, 38 and 40, which are pieces of the entire puzzle, come apart but are held together when properly aligned by magnet 42 mounted in the center of the pyramid. Each piece has a metal or magnetic piece attached to it that is aligned when the entire pyramid is build such as in FIG. 9, such that the magnetic piece or metal piece that is attracted to the magnet will be engaged in magnet 42.

FIG. 11 shows one of the pieces 36 that forms the isosceles triangle along edge 361 and polygon faces 363 and 364 which engage adjacent pieces 38 and 40. The metal fastener 44 which can be a magnet or a piece of metal that is magnetizable is connected in a diamond shaped area 362 that fits into the space shown in FIG. 10 so that element 44 which is magnetizable can engage magnet 42 holding piece 36 in place. Again the important part of the puzzle is to allow the user to assemble all of the elements or pieces of the puzzle 32, 34, 36, 38 and 40 and the corresponding remaining piece on the other side around the magnet 42 which takes dexterity, and an understand of geometry. The specific pyramid puzzle shown in FIGS. 9, 10, and 11 has 6 pieces, shaped as shown in FIG. 11, that form the equalized triangle side on three sides of the pyramid and three base elements such as 34 and 40. Thus, the entire pyramid shown in FIG. 9 as assembled will include 6 total pieces, plus the center magnet 42. All 6 pieces will have a magnetizable element or magnet attached thereto to hold the puzzle together with magnets 42.

The piece 36 shown in FIG. 11, forms one of the pyramid equilateral edges 361. The magnetically attractive element 44 may be a screw or other type of metal piece that is physically attached to the diamond end face 362 that is in the inside of the puzzle when all the pieces are together.

Each puzzle piece for the pyramid is comprised of a seven faced polyhedron. Two of the faces are formed of 30° isosceles triangles of the same dimensions and that are at a 30° angle to each other. Four of the faces are triangles that are not equilateral or isosceles but are of the same dimensions. The final face housing the metal element such as a screw that can be magnetized is diamond shaped and a parallelogram wherein one edge forms one of the triangle legs of the four triangular faces that are not equilateral or isosceles triangles. Four of the faces that are made up of triangles that are not equilateral or isosceles share a common mid leg and form a mirror image on each side of a ridge along the puzzle piece for top and bottom purposes.

Figure 12:
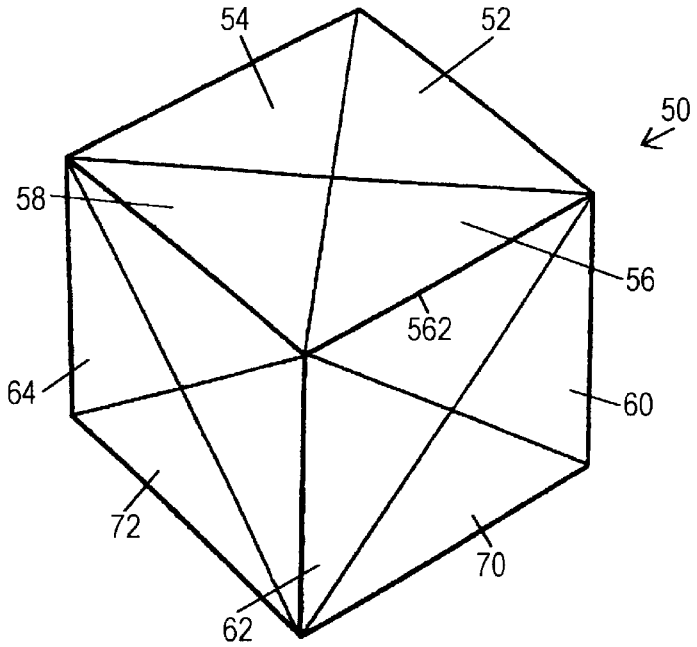
FIG. 12 shows a perspective view of a cube made in accordance with the present invention.
Figure 13:
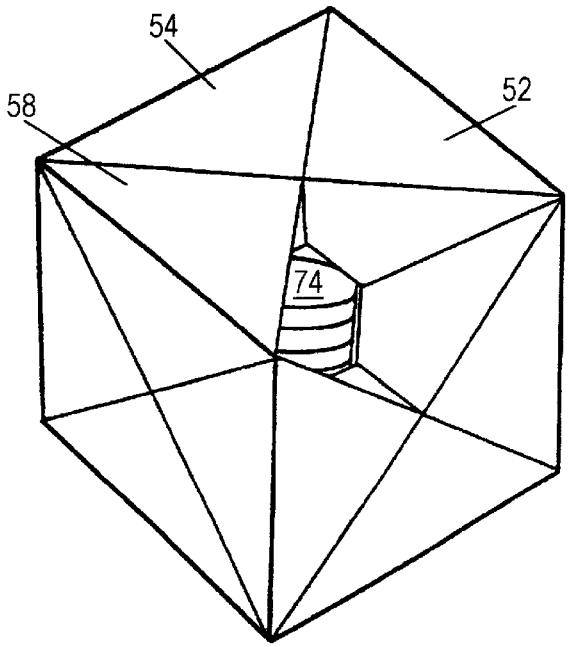
FIG. 13 shows a perspective view of the cube of FIG. 13 with a piece of the puzzle or building component of the puzzle removed, exposing the interior magnet.
Figure 14:
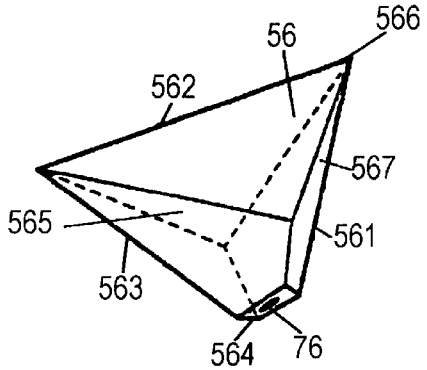
FIG. 14 shows a removed piece of the cube including its magnetic element, such as a metal tip that allows it to be engaged with the magnet.

Referring now to FIGS. 12, 13, and 14 another embodiment of the invention is shown in which the puzzle is comprised of a geometrical figure forming a cube. Thus, the puzzle is a six sided cube where all of the sides are of equal length. The entire puzzle shown in FIGS. 13 and 14 is made up of twelve individual identical polyhedrons or pieces including pieces 52, 54, 56 and 58, which represent the top most tier of the cube. All twelve pieces include a magnetic element 76 shown in FIG. 14 that attaches to the magnet 74 shown in FIG. 13 that resides in the inside of the cube when all the pieces are in place. Again, the objective of the puzzle is to engage each of the polyhedron pieces or elements in such a way to form a cube with all of the pieces being attached to the magnet through the connection of the magnet 74 and a magnetizable metal piece 76, for example as shown on piece 56. The upper tier of pieces for the cube include polyhedrons, the back of which forms one of the cube edges along the top out of the four cube edges. Therefore, there are four top pieces, 52, 54, 56 and 58 which fit together in such a way as to form the upper face and the upper portion of the cube.

Four middle tier pieces including pieces 62 and 64 form mid section pieces around the cube, there being four such pieces in the mid section.

The base pieces 70 and 72 are the same on the opposite sides as shown. Therefore, piece 62 engage base pieces 70 and 72 along with pieces 56 and 58 which are all in contact. Every piece is identical in shape as shown in FIG. 15.

Referring to FIG. 14, the edge 562 forms the upper edge of the cube as shown for element 56. The center piece 564 is a face that is substantially rectangular that includes a metal element attached such as a screw head that can be magnetized or a magnet that can be attracted to magnet 74. Each of the twelve pieces that form the cube are identical in shape. Each puzzle piece is a polyhedron having a total of seven faces. Two of the faces are defined at a 90° angle to each other and are isosceles triangles joined along a common base. Both sides of the isosceles triangles are identical in length as compared with each other. Four of the faces are trapezoids, each having one side that terminates in the seventh face which is approximately diamond shaped. The seventh face includes a metal screw that can be magnetized as an attracting element. The four trapezoids are substantially the same shape and size and are mirror images of each other along a common mid legs.

To assemble the device all the pieces will be spread out and a first piece will be attached to the magnet and each subsequent piece through skill can be then attached around the magnet 74 until a perfect cube is formed. All puzzle pieces include a metal element that can be magnetized and attached to the magnet. All puzzle pieces are identical in shape.

Thus, as shown the puzzle can be made in a spherical shape, it can be in the form of a four sided pyramid that has four isosceles triangles and it can be made in the form of a cube.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A cube puzzle comprising in combination:

twelve individual puzzle pieces, each individual puzzle piece being substantially identical to one another, each individual puzzle piece having at least two identical triangular faces perpendicular to one another at a base that together form one exterior side edge of a cube, each individual puzzle piece having identical trapezoid faces inward from the triangular faces, the cube having six side surfaces and twelve exterior side edges; and a magnet core for magnetically capturing said twelve individual puzzle pieces together, each of said individual puzzle pieces containing a metal portion and being magnetically connectible to said magnet core, each of said individual puzzle pieces being identically mounted, and forming a preselected three dimensional cube shape when joined together with said magnet core.

* * * * *